US006929165B1

(12) United States Patent
Chen et al.

(10) Patent No.: US 6,929,165 B1
(45) Date of Patent: Aug. 16, 2005

(54) PNEUMATIC NAIL GUN

(75) Inventors: Ruey-Zon Chen, Tali (TW); Eric Lo, Tali (TW); George Ku, Taiping (TW)

(73) Assignee: Rexon Industrial Corp., Ltd., Taichung Hsien (TW)

( * ) Notice: Subject to any disclaimer, the term of this patent is extended or adjusted under 35 U.S.C. 154(b) by 0 days.

(21) Appl. No.: 10/910,296

(22) Filed: Aug. 4, 2004

(51) Int. Cl.[7] ..... B25C 1/04
(52) U.S. Cl. ..... 227/8; 227/142
(58) Field of Search ..... 227/8, 109, 120, 227/130, 142

(56) References Cited

U.S. PATENT DOCUMENTS 5,219,110 A * 6/1993 Mukoyama ..... 227/8
5,593,079 A * 1/1997 Mukoyama et al. ..... 227/8
5,715,982 A * 2/1998 Adachi ..... 227/8
5,785,227 A * 7/1998 Akiba ..... 227/8
6,024,267 A * 2/2000 Chen ..... 227/8
6,170,729 B1 * 1/2001 Lin ..... 227/8
6,186,386 B1 * 2/2001 Canlas et al. ..... 227/142
6,578,750 B2 * 6/2003 Kubo et al. ..... 227/142
6,581,815 B1 * 6/2003 Ho et al. ..... 227/142

* cited by examiner

*Primary Examiner*—Scott A. Smith
(74) *Attorney, Agent, or Firm*—Rosenberg, Klein & Lee

(57) ABSTRACT

A pneumatic nail gun has a body, a nail magazine, an actuating device, a trigger assembly and a push bar assembly. The body has a housing, a handle and a nail firing device. The actuating device is mounted between the housing and the handle. The actuating device has a channel, a piston rod, an O-ring and a first spring to provide a restitute force to the piston rod. The trigger assembly is attached to the body and has an inner cap pivotally attached to the body, an outer cap slidably attached outside the inner cap, an actuating lever pivotally attached inside the inner cap and a second spring. Accordingly, the outer cap can be moved to a lock position to keep the nails from being fired unintentionally, and the pneumatic nail gun is safe in use.

9 Claims, 9 Drawing Sheets

PNEUMATIC NAIL GUN

BACKGROUND OF THE INVENTION

1. Field of the Invention

The present invention relates to a pneumatic nail gun, and more particularly to a pneumatic nail gun that can improve the safety in use.

2. Description of Related Art

To improve the safety of using a pneumatic nail gun, a push bar is mounted on the pneumatic nail gun, such that the pneumatic nail gun will shoot a nail only when the user pushes the trigger and abuts the push bar against a target simultaneously. In addition, a pneumatic nail gun will be provided with a burst device to shoot the nails continuously until the user releasing the trigger.

However, when the user make the push bar of the conventional pneumatic nail gun abut against a person unintentionally and pushes the trigger simultaneously, the nail will be fired and easily injure the person, especially to a pneumatic nail gun with a burst device.

To overcome the shortcomings, the present invention tends to provide a pneumatic nail gun to mitigate or obviate the aforementioned problems.

SUMMARY OF THE INVENTION

The main objective of the invention is to provide a pneumatic nail gun that is safe in use. The pneumatic nail gun has a body, a nail magazine, an actuating device, a trigger assembly and a push bar assembly. The body has a housing with an inner space, a handle attached to the housing and a nail firing device mounted in the housing. The handle has an air chamber and a cavity. The actuating device is mounted between the housing and the handle to control the high-pressure air in the air chamber to flow into the inner space in the housing. The actuating device has a channel, a piston rod moveably received in the channel, an O-ring mounted around the piston rod and a first spring to provide a restitute force to the piston rod. The trigger assembly is attached to the body and has an inner cap pivotally attached to the body, an outer cap slidably attached outside the inner cap, an actuating lever pivotally attached inside the inner cap and a second spring. The push bar assembly is moveably mounted in the housing of the body for moving the actuating lever of the trigger assembly when the push bar assembly abuts against an object. Accordingly, the outer cap can be moved to a lock position to keep the nails from being fired unintentionally.

Other objects, advantages and novel features of the invention will become more apparent from the following detailed description when taken in conjunction with the accompanying drawings.

DETAILED DESCRIPTION OF PREFERRED EMBODIMENT

Figure 1:
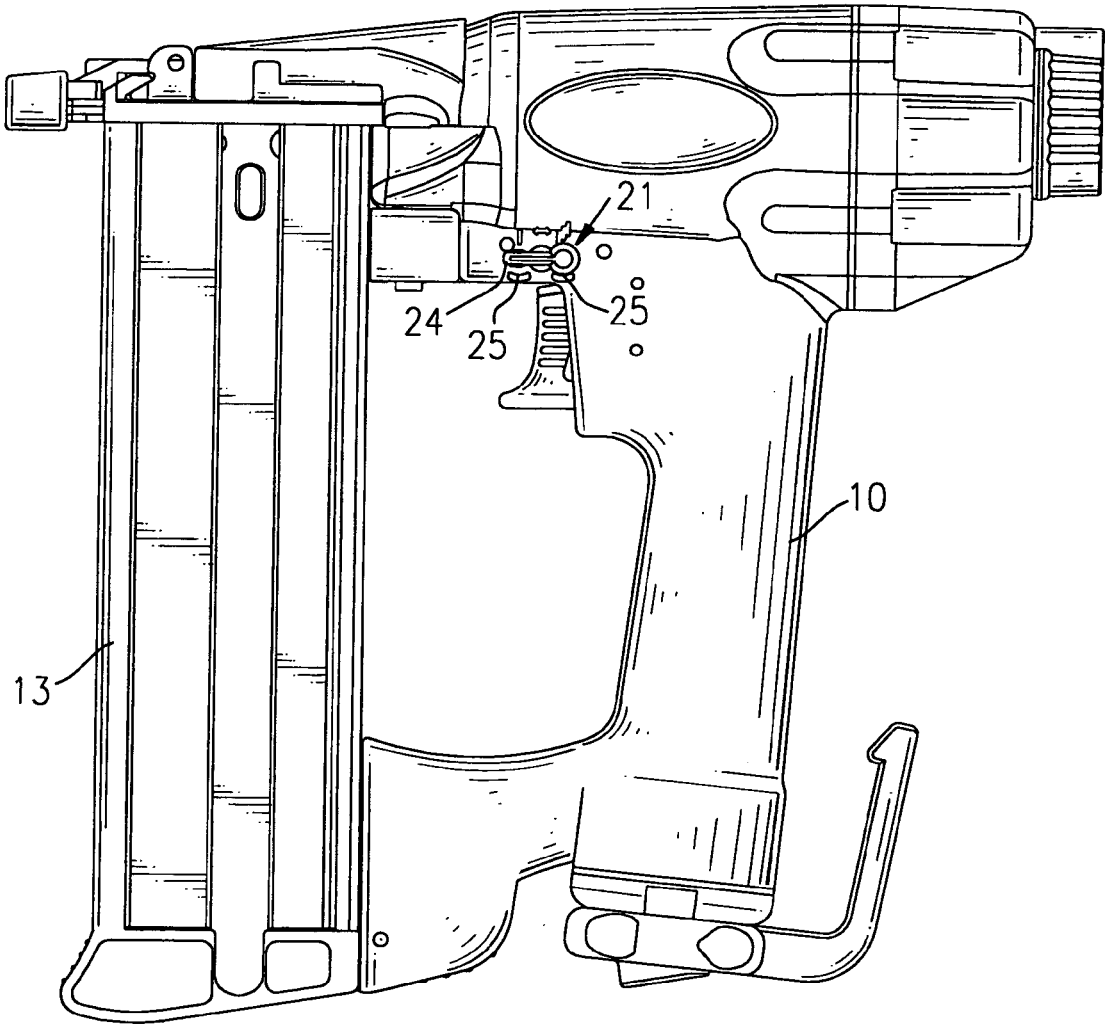
FIG. 1 is a side plan view of a pneumatic nail gun in accordance with the present invention.
Figure 2:
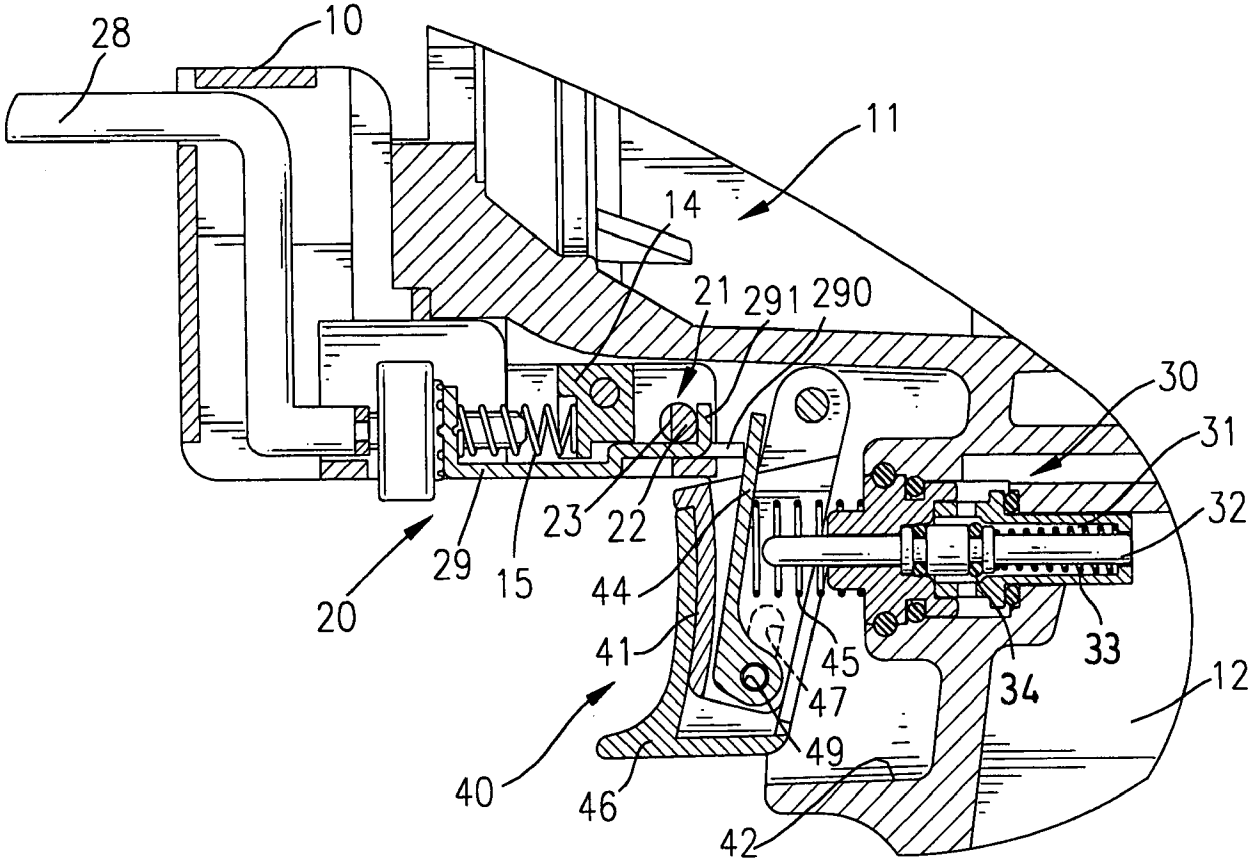
FIG. 2 is an enlarged side plan view in partial cross section of a trigger of the pneumatic nail gun in FIG. 1.

With reference to FIGS. 1 and 2, a pneumatic nail gun in accordance with the present invention comprises a body (10), a nail magazine (13), an actuating device (30), a trigger assembly (40), a push bar assembly (20) and optionally a switch device (21). The body (10) has a housing and a handle. The housing has a bottom and an inner space, and the handle is formed on the bottom of the housing. The handle has a bottom, an air chamber (12) and a cavity (42). The air chamber (12) is defined in the handle and communicates with the inner space in the housing. A connector is mounted on the bottom of the handle to connect to an air source through a hose, such that high-pressure air can be led into the air chamber (12) through the hose and the connector. The cavity (42) is defined in the handle and has an inner surface.

The nail magazine (13) is attached to the bottom of the housing and is connected to the handle to provide nails into the body one after one. In addition, the body further has a nail firing device received in the housing to shoot nails supplied from the nail magazine in cooperation with the high pressure air supplied from the air chamber (12). The nail firing device has a control valve. When the control valve is opened, the high-pressure air in the inner space in the housing will be released for firing the nail. The structures of the nail magazine and the nail firing device with the control valve are same as the prior art and are not further described.

The actuating device (30) is mounted between the housing and the handle to control the high-pressure air in the air chamber (12) to flow into the inner space in the housing. The actuating device (30) comprises a channel (31), a piston rod (32), an O-ring (34) and a first spring (33). The channel (31) is defined in the handle, communicates with the air chamber (12) and the inner space in the housing and has an inner surface. The piston rod (32) is moveably received in the channel (31) and is connected to the control valve of the nail firing device to control the operation of the control valve. The connecting structure between the piston rod (32) and the control valve is same as prior art and is not further described. The piston rod (32) has a distal end extending into the cavity (42) in the handle. The O-ring (32) is mounted around the piston rod (32) to selectively abut against the inner surface of the channel (31). The first spring (33) is mounted around the piston rod (32) to provide a restitute force to the piston rod (32).

Figure 3:
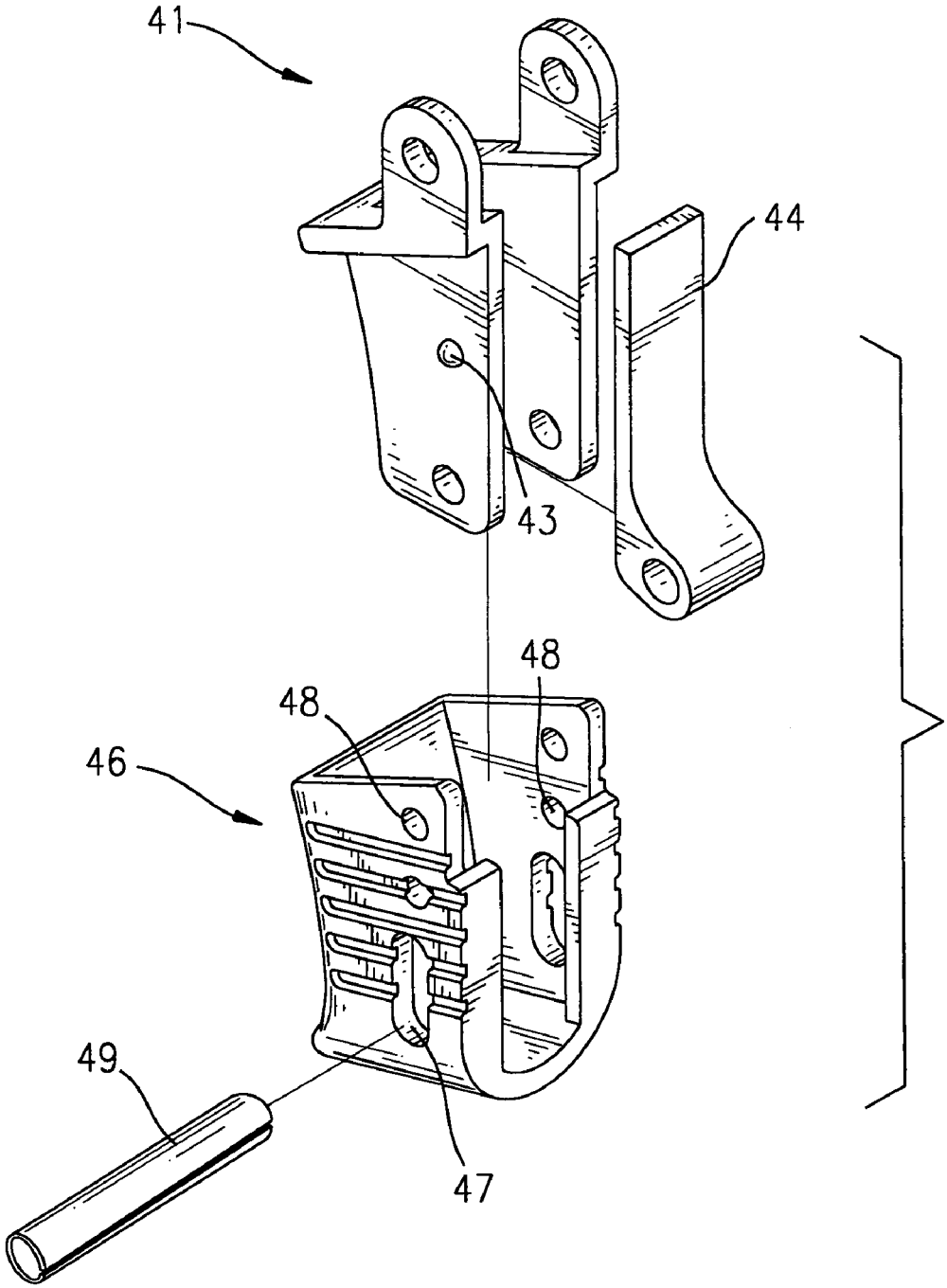
FIG. 3 is an exploded perspective view of the trigger in FIG. 2.

With further reference to FIG. 3, the trigger assembly (40) is pivotally attached in the cavity (42) in the handle and comprises an inner cap (41), an outer cap (46), an actuating lever (44) and a second spring (45). The inner cap (41) has a U-shaped cross section, is pivotally attached to the body and corresponds to the cavity (42) in the handle. The outer cap (46) is slidably attached outside the inner cap (42). In a preferable embodiment, a longitudinal slot (47) is defined through the outer cap (46), and a through hole (not numbered) is defined through the inner cap (41) and corresponds to the slot (47) in the outer cap (46). A pivot pin (49) extends through the slot (47) in the outer cap (46) and the through hole in the inner cap (41). Two bores (48) are defined in the outer cap (46) and are arranged in a row along the slot (47). A knob (43) is formed on the inner cap (41) and selectively engages with one of the bores (48) in the outer cap (46). With the engagement between the knob (43) and the corresponding bore (48), the outer cap (46) will be placed in position relative to the inner cap (41). When a force is applied to pull the outer cap (46), the knob (43) will be forced to disengage from the corresponding bore (48) and the outer cap (46) will move relative to the inner cap (41) along the slot (47).

The actuating lever (44) is pivotally attached inside the inner cap (41) and corresponds to the distal end of the piston rod (32). The actuating lever (44) has a distal end away from the pivot point between inner cap (41) and the actuating lever (44). The second spring (45) is mounted between the actuating lever (44) and the inner surface of the cavity (42) to make the actuating lever (44) separate from the distal end of the piston rod (32).

The push bar assembly (20) is mounted in the housing and has a push bar (28), an actuating arm (29) and a third spring (15). The push bar (28) is moveably mounted in the housing and has a distal end extending out from the housing and a proximal end extending into the housing. The actuating arm (29) is moveably received in the housing and has a distal end connected to the proximal end of the push bar (28) and a proximal end. The actuating arm (29) further has a tongue (290) laterally extending from the proximal end to abut against the distal end of the actuating lever (44) and a tab (291) vertically extending from the actuating arm (29) near the proximal end. The third spring (15) is mounted between the housing and the actuating arm (29) to provide a restitute force to the actuating arm (29). In a preferable embodiment, a post (not numbered) is formed on the actuating arm (29) and a block (14) is formed in the housing, and the third spring (15) has two ends abutting respectively to the post and the block (14). Accordingly, when the push bar (28) is abutted against an object, the push bar (28) with the actuating arm (29) will be moved relative to the housing.

Figure 4:
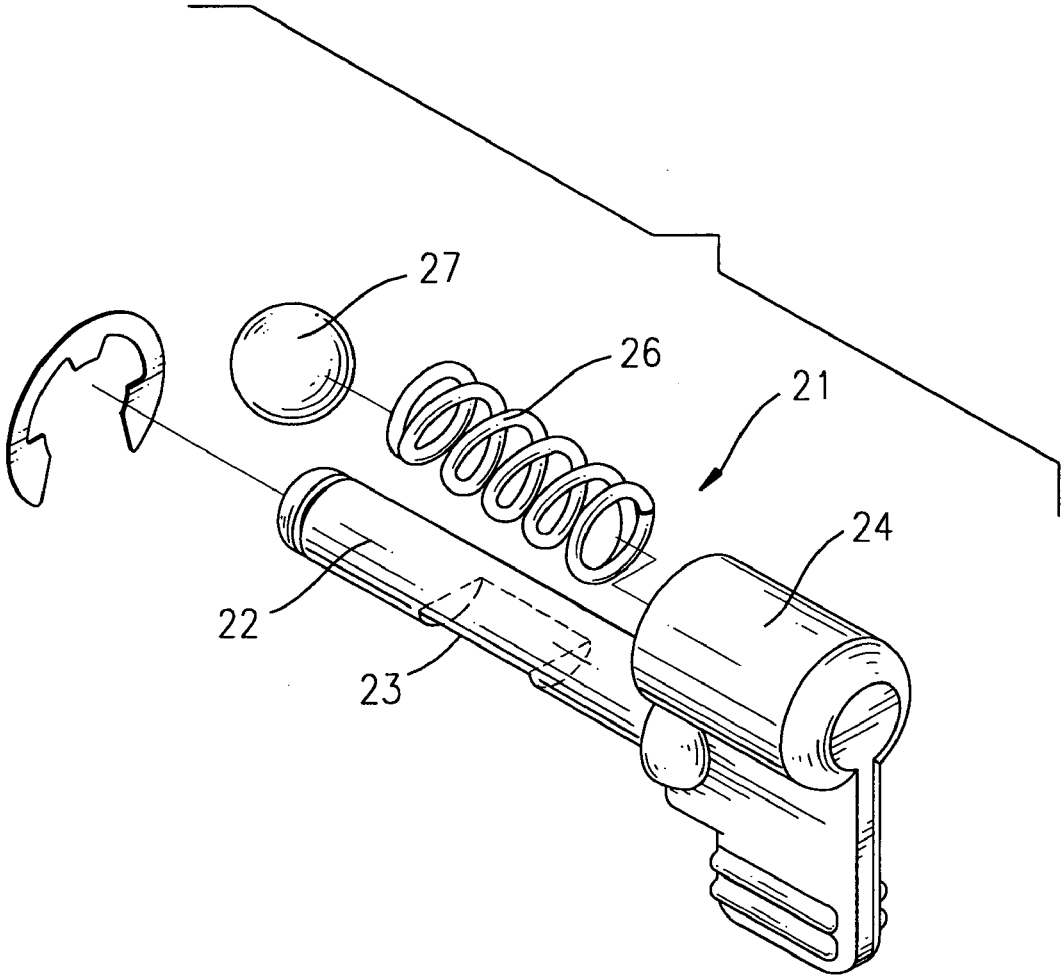
FIG. 4 is an exploded perspective view of a in FIG. 2.

With further reference to FIG. 4, the optional switch device (21) is rotatably attached to the housing of the body and comprises a switch rod (22) and a positioning device. The switch rod (22) is rotatably mounted on and extends through the housing of the body. The switch rod (22) has a distal end, a middle portion and a cutout (23) defined in the middle portion and corresponding to the tab (291) on the actuating arm (29). The positioning device is mounted on the distal end of the switch rod (22) and comprises a sleeve (24), a ball (27) and a biasing member (26). The sleeve (24) is formed on the distal end of the switch rod (22) and has a hole defined in the sleeve (24). The biasing member (26) is received in the hole in the sleeve (24), and the ball (27) is supported and is partially exposed from the hole in the sleeve (24). The housing has two positioning holes defined in the housing, and the ball (27) is selectively received one of the positioning holes in the housing. With the engagement of the ball (27) and the corresponding positioning hole, the switch rod (22) can be held in place relative to the housing.

Figure 5:
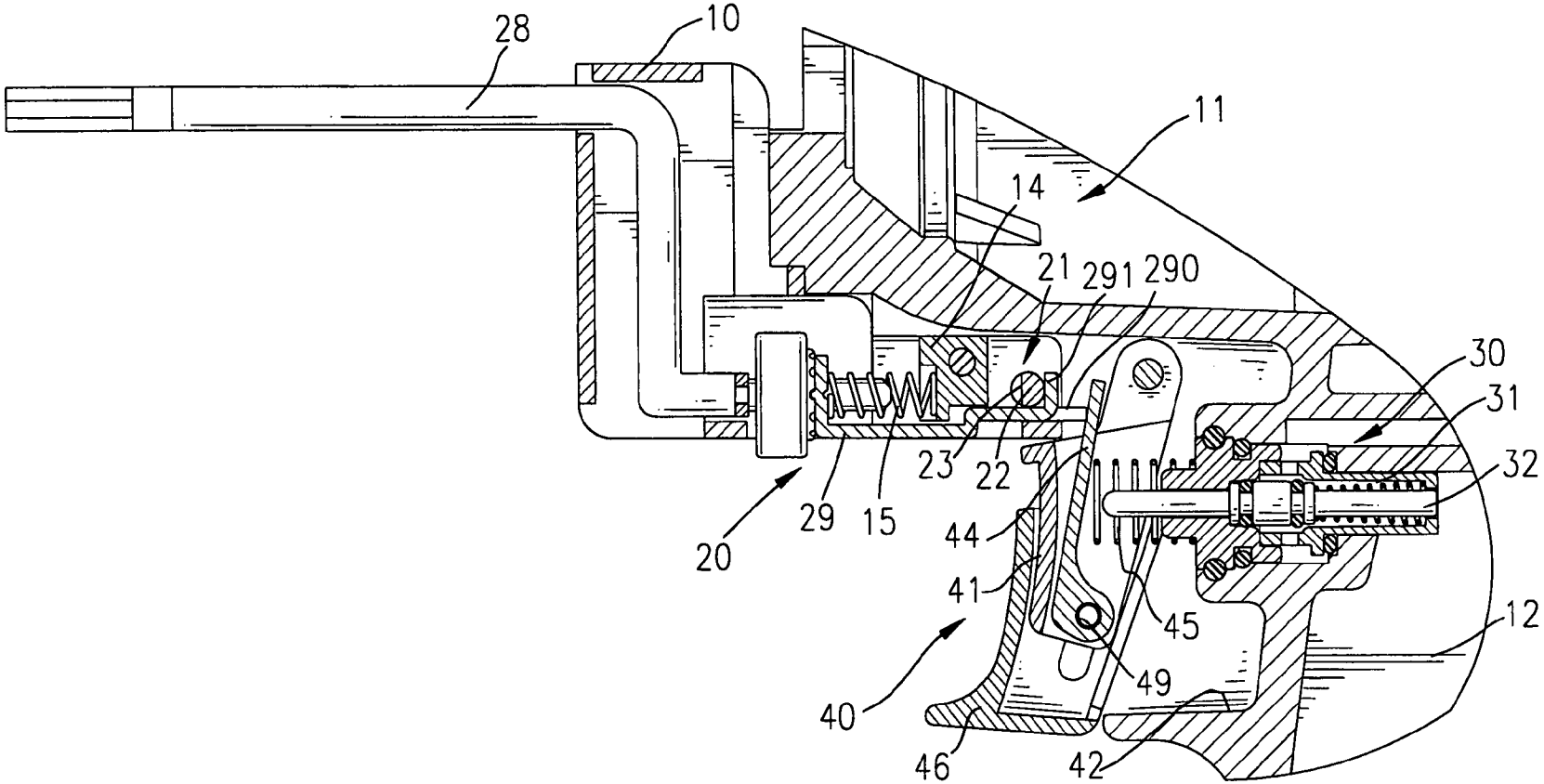
FIG. 5 is a side plan view in partial cross section of the trigger in FIG. 2 showing that the trigger is in a lock position.

With reference to FIG. 5, when the pneumatic nail gun is not in work, the user can pull the outer cap (46) downward to make the outer cap (46) move to a position where the bottom of the outer cap (46) escapes from the cavity (42) in the handle. Accordingly, when the outer cap (46) is pushed, the handle will block the outer cap (46) and the outer cap (46) with the inner cap (41) will not pivotally rotate relative to the handle. Therefore, the trigger assembly (40) is held in a lock position, and the nails will not be shot even that the user pushes the trigger assembly (40). The safety of using the pneumatic is improved.

Figure 6:
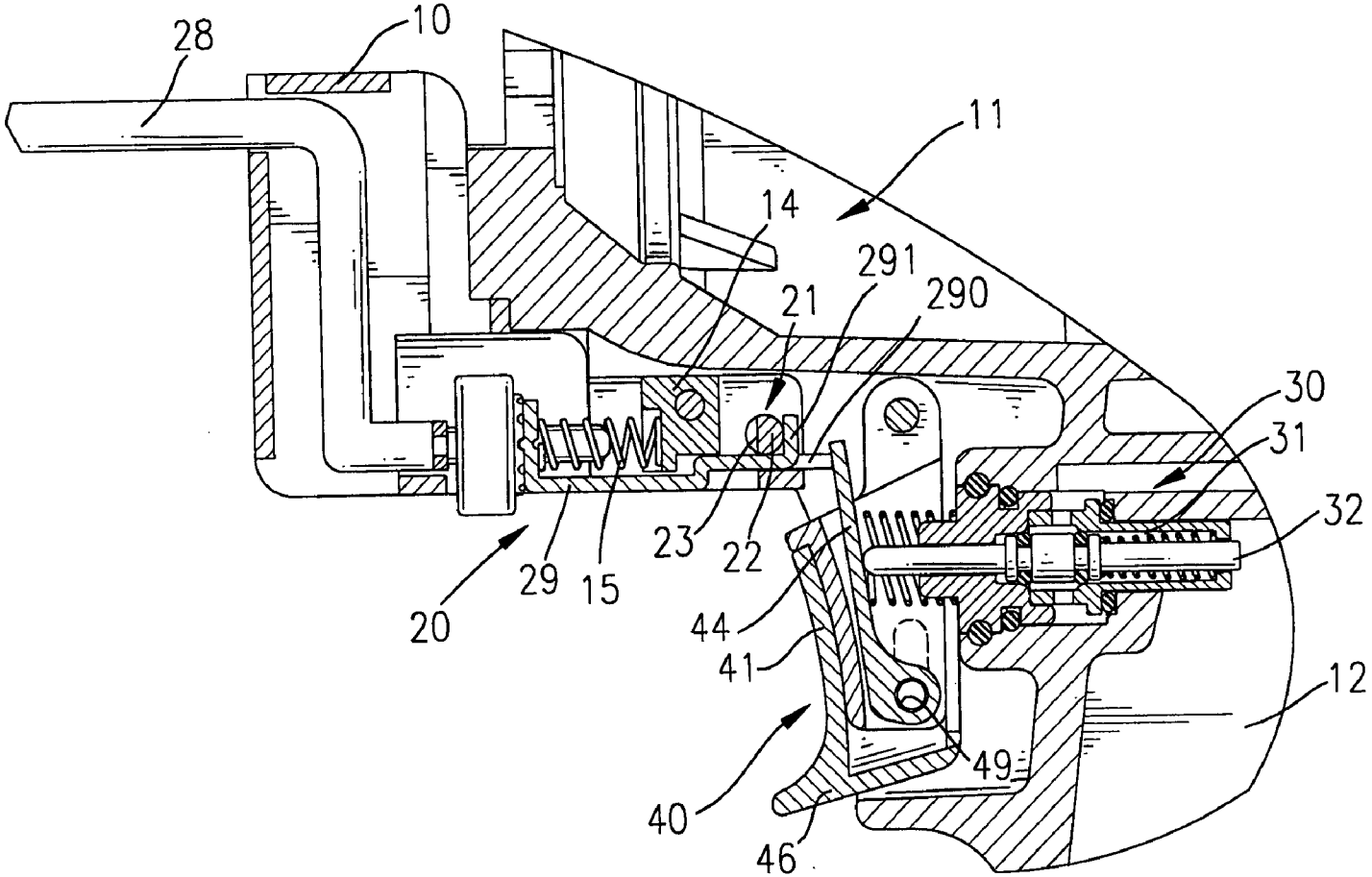
FIG. 6 is an operational side plan view in partial cross section of the trigger in FIG. 2 showing that the pneumatic nail gun is in a single shot condition and the trigger is pushed.
Figure 7:
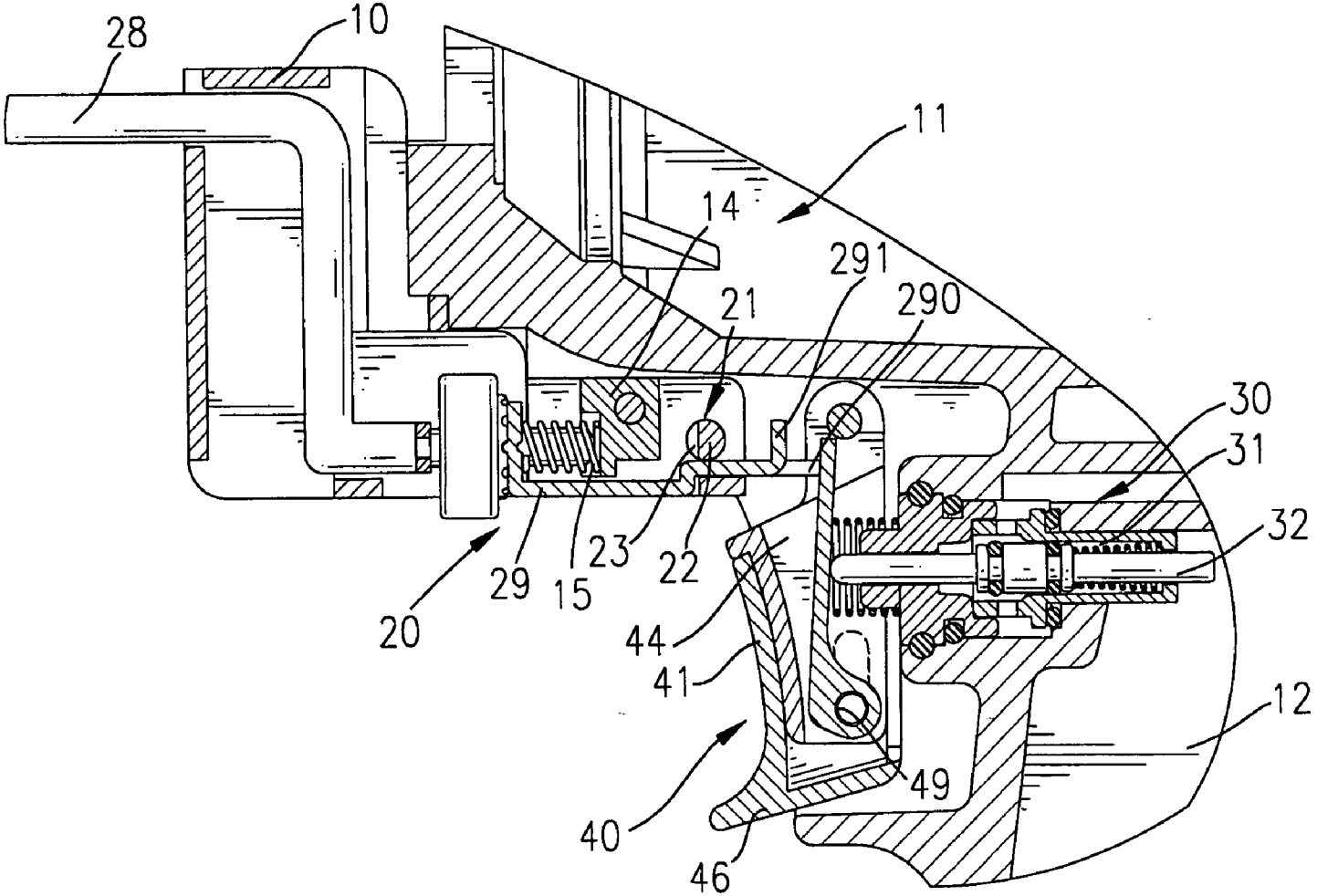
FIG. 7 is an operational side plan view in partial cross section of the trigger in FIG. 2 showing that the pneumatic nail gun is in a single shot condition and the outer cap is released.

With reference to FIGS. 6 and 7, after moving the outer cap (46) upward to make the outer cap (46) correspond to the cavity (42) in the handle, the user can push the outer cap (46) to pivotally rotate the outer cap (46) with the inner cap (41) relative to the handle. The actuating lever (44) will rotate with the inner cap (41) to abut against the distal end of the piston rod (32), but the piston rod (32) is not moved. When the push bar (28) abuts against a target object, such as a wall, the push bar (28) with the actuating arm (29) will be moved relative to the housing. Accordingly, the tongue (290) on the actuating arm (29) will push the actuating lever (44) to pivotally rotate relative to the inner cap (41) so as to move the piston rod (32) relative to the channel (31). The O-ring (34) will seal the channel (31) when the piston rod (32) is moved, and the control valve of the nail firing device will be opened. Consequently, the high-pressure air in the inner space of the housing will be released for firing a nail in the housing.

With such an arrangement, before the push bar (28) abutting against a target object, the piston rod (32) will not be moved even when the user pushes against the trigger assembly (40). Moreover, because the second spring (45) separates the actuating lever (44) from the distal end of the piston rod (32), the piston rod (32) will not be moved even when the push bar (28) abuts against a target object. Therefore, to push the push bar (28) and the trigger assembly (40) simultaneously is necessary for shooting a nail, such that a person standing near the pneumatic nail gun will not be injured unintentionally and the use of the pneumatic is safe.

To set up the pneumatic nail gun in a single shot condition, the switch rod (22) is rotated to a position where the cutout (23) is away from the tab (291). When the push bar (28) leaves away from the target, the actuating lever (44) will be pushed to pivotally rotate backward by the restitute force provided by the second spring (45). The tab (291) will abut against the switch rod (22) at a position beside the cutout (23), and the travel of the actuating arm (29) is shortened. Accordingly, the short travel of the actuating arm (29) will not make the O-ring (34) on the piston rod (32) escape from the channel (31), such that the high-pressure air in the air chamber (12) will not enter into the inner space in the housing through the channel (31). Therefore, the next nail will not be shot even the trigger assembly (40) is still pushed. To shoot the next nail, the user must release the trigger assembly (40) firstly to make the outer cap (46) with the inner cap (47) rotate out from the cavity (42). The piston rod (32) will be moved by the first spring (33), and the O-ring (34) will escape from the channel (31) to allow the high-pressure air passing through the channel (31) and entering into the inner space in the housing. Then, the control valve of the nail firing device will be closed. Consequently, the user can shoot a nail out from the nail gun when the user pushes the trigger assembly (40) and abuts the push bar (28) against the target.

Figure 8:
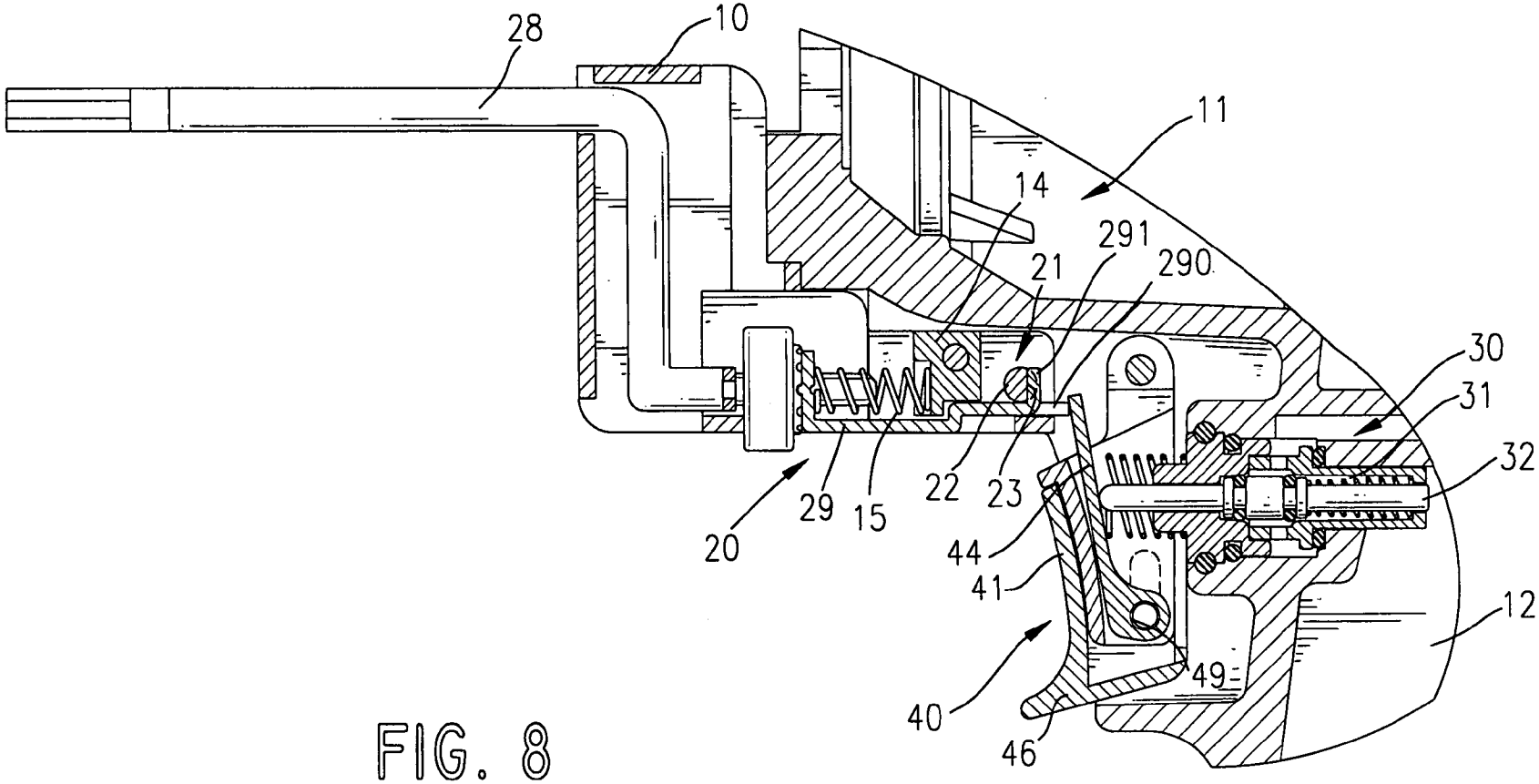
FIG. 8 is an operational side plan view in partial cross section of the trigger in FIG. 2 showing that the pneumatic nail gun is in a burst condition.
Figure 9:
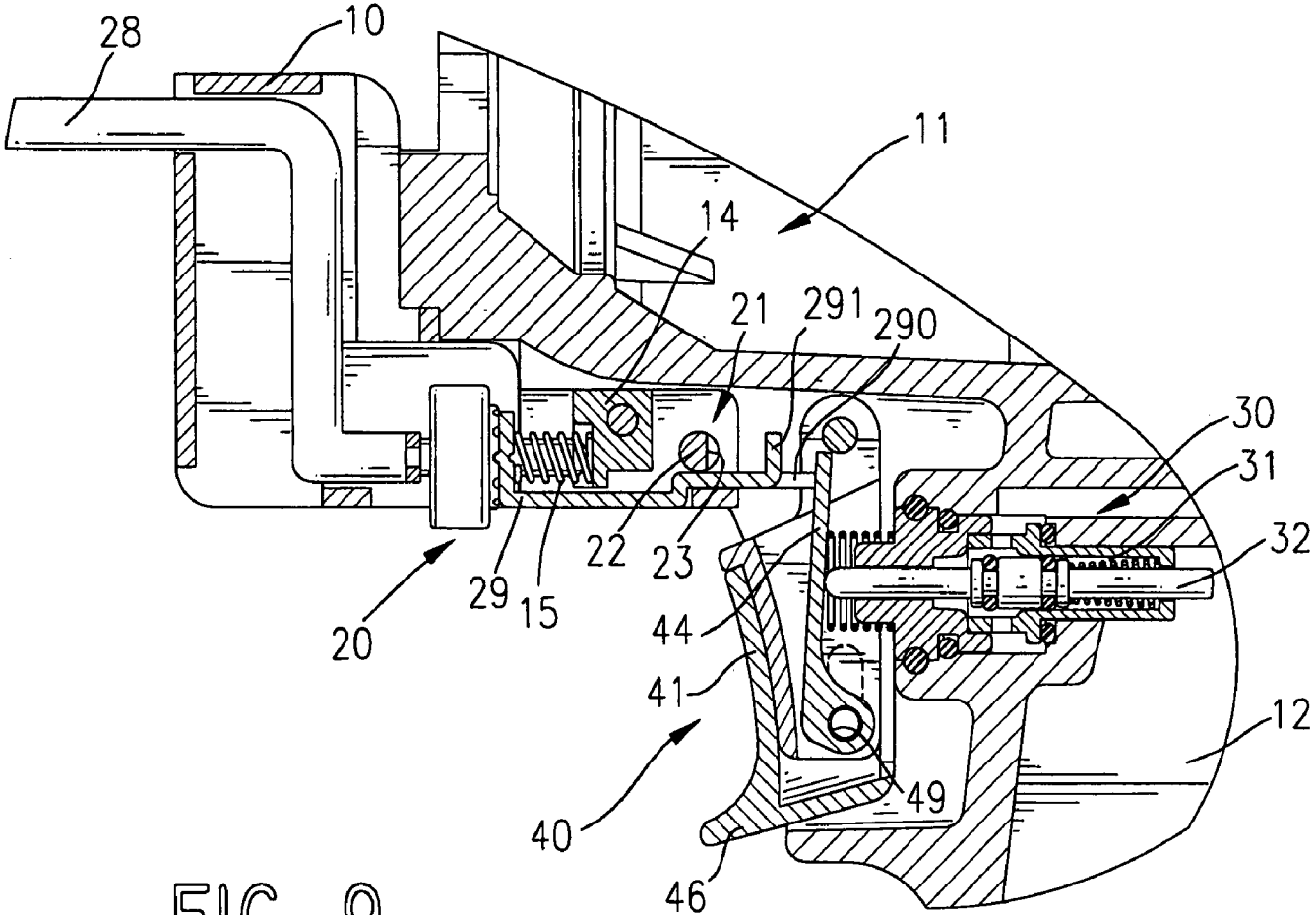
FIG. 9 is an operational side plan view in partial cross section of the trigger in FIG. 2 showing that the pneumatic nail gun is in a burst condition and the outer cap is released.

With reference to FIGS. 8 and 9, to set up the pneumatic nail gun in a burst condition, the switch rod (22) is rotated to a position where the cutout (23) faces the tab (291) on the actuating arm (29). With the cutout (23), the travel of the actuating arm (29) moving backward is enlarged, and the actuating lever (44) will rotate to a position where the O-ring (34) escapes from the channel (31). Accordingly, the air in the air chamber (12) will flow into the inner space in the housing through the channel (31) even the trigger assembly (40) is still pushed. When the user abuts the push bar (28) against the target, the piston rod (32) will be moved to close the channel (31) with the O-ring (34) and the next nail will be shot.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic nail gun comprising:

a body having a housing having an inner space and a bottom;

a handle attached to the bottom of the housing and having an air chamber communicating with the inner space in the housing, a cavity with an inner surface and a connector for being connected to a high-pressure air source through a hose; and a nail firing device with a control valve mounted in the inner space in the housing for firing a nail;

a nail magazine attached to bottom of the housing to receive and supply nails;

an actuating device mounted between the housing and the handle to control the high-pressure air in the air chamber to flow into the inner space in the housing and having a channel defined in the handle, communicates with the air chamber and the inner space in the housing and having an inner surface;

a piston rod moveably received in the channel, connected to the control valve of the nail firing device to operate the control valve and having a distal end extending into the cavity in the handle;

an O-ring mounted around the piston rod to selectively abut against the inner surface of the channel; and a first spring mounted around the piston rod to provide a restitute force to the piston rod;

a trigger assembly attached to the body and comprising an inner cap with an U-shaped cross section pivotally attached to the body and corresponding to the cavity in the handle;

an outer cap slidably attached outside the inner cap;

an actuating lever pivotally attached inside the inner cap, corresponding to distal end of the piston rod and having a distal end; and a second spring mounted between the actuating lever and the inner surface of the cavity to make the actuating lever separate from the distal end of the piston rod; and a push bar assembly moveably mounted in the housing of the body for moving the actuating lever of the trigger assembly when the push bar assembly abuts against an object.

2. The pneumatic nail gun as claimed in claim 1, wherein the push bar assembly comprises a push bar moveably mounted in the housing and having a distal end extending out from the housing and a proximal end extending into the housing; and an actuating arm moveably received in the housing and having a distal end connected to the proximal end of the push bar and a proximal end abutting against the distal end of the actuating lever of the trigger assembly.

3. The pneumatic nail gun as claimed in claim 2, wherein the push bar assembly further comprises a tongue laterally extending from the proximal end of the actuating arm and abutting against the distal end of the actuating lever of the trigger assembly.

4. The pneumatic nail gun as claimed in claim 3, wherein the push bar assembly further comprises a third spring mounted between the housing and the actuating arm to provide a restitute force to the actuating arm.

5. The pneumatic nail gun as claimed in claim 4, wherein a post is formed on the actuating arm;

a block is formed in the housing; and the third spring has two ends abutting respectively to the post and the block.

6. The pneumatic nail gun as claimed in claim 1, wherein the trigger assembly further has a longitudinal slot defined through the outer cap;

a through hole defined through the inner cap and corresponding to the slot in the outer cap;

a pivot pin extending through the slot in the outer cap and the through hole in the inner cap;

two bores defined in the outer cap and arranged in a row along the slot; and a knob formed on the inner cap and selectively engaging with one of the bores in the outer cap.

7. The pneumatic nail gun as claimed in claim 1 further comprising a switch device mounted on the body to switch the nail gun between a single shot condition and a burst condition.

8. The trigger assembly for as claimed in claim 7, wherein the switch device comprises a switch rod rotatably mounted on and extending through the housing of the body, the switch rod having a distal end, a middle portion and a cutout defined in the middle portion; and a positioning device mounted on the distal end of the switch rod to held the switch rod in place relative to the housing; and the actuating arm of the push bar assembly further has a tab vertically extending from the actuating arm near the proximal end and corresponding to the cutout in the switch rod.

9. The trigger assembly for as claimed in claim 8, wherein the positioning device comprises a sleeve formed on the distal end of the switch rod and having a hole defined in the sleeve;

a biasing member received in the hole in the sleeve; and a ball supported by the biasing member and partially exposed from the hole in the sleeve;

the housing has two positioning holes; and the ball is selectively received one of the positioning holes in the housing.

* * * * *